United States Patent [19]

Wisotsky

[11] 4,019,878

[45] Apr. 26, 1977

[54] ADDITIVE COMBINATION FOR COLD FLOW IMPROVEMENT OF MIDDLE DISTILLATE FUEL OIL

[75] Inventor: Max J. Wisotsky, Highland Park, N.J.

[73] Assignee: Exxon Research and Engineering Company, Linden, N.J.

[22] Filed: Dec. 17, 1974

[21] Appl. No.: 533,513

[52] U.S. Cl. ..... 44/62; 44/66; 44/70

[51] Int. Cl.[2] ..... C10L 1/20

[58] Field of Search ..... 44/66, 62, 70, 80; 208/33, 28

[56] References Cited

UNITED STATES PATENTS

| | | | |
|---|---|---|---|
| 2,107,772 | 2/1938 | Wade | 204/184 |
| 3,449,251 | 6/1969 | Tunkel et al. | 44/62 |
| 3,454,379 | 7/1969 | Isaacson et al. | 44/62 |
| 3,638,349 | 2/1972 | Wisotsky et al. | 44/62 |
| 3,645,704 | 2/1972 | Burkard et al. | 44/62 |
| 3,762,888 | 10/1973 | Kober et al. | 44/62 |

*Primary Examiner*—Floyd D. Higel
*Assistant Examiner*—Mrs. Y. Harris-Smith
*Attorney, Agent, or Firm*—Roland A. Dexter; Frank T. Johmann

[57] ABSTRACT

Additive combinations of (A) ethylene-containing polymers, e.g. copolymers of about 4 to 30 molar proportions of ethylene copolymerized with an unsaturated ester, with: (B) beeswax, (C) ozokerite wax, and/or (D) long chained $\alpha$-olefins are cold flow improvers for middle-distillate petroleum fuels.

11 Claims, No Drawings

ADDITIVE COMBINATION FOR COLD FLOW IMPROVEMENT OF MIDDLE DISTILLATE FUEL OIL

BACKGROUND OF THE INVENTION

1. Field of the Invention

The invention relates to a combination of an ethylene-containing polymer with very long chain hydrocarbons containing oil solubilizing groups, said hydrocarbons illustrated by beeswax, ozokerite wax and/or long chain α-olefins, for improving the cold flow properties of distillate fuel oil.

2. Description of the Prior Art

Kerosene, which is a solvent for wax, has traditionally been a component of distillate fuel oils, e.g. diesel fuels, home heating oils, etc. With the demands for kerosene for use in jet fuels, the amount of kerosene used in distillate fuel oils has decreased over the years. This, in turn, has frequently required the addition of wax crystal modifiers, e.g. pour point depressant additives, to the fuel oil to make up the lack of kerosene.

One class of such pour point depressant additives are ethylene containing polymers. The more effective of these polymers for distillate fuel oil are copolymers of ethylene with other monomers, e.g. copolymers of ethylene and vinyl esters of lower fatty acids such as vinyl acetate (U.S. Pat. No. 3,048,479); copolymers of ethylene and alkyl acrylate (Canadian Pat. No. 676,875); terpolymers of ethylene with vinyl esters and alkyl fumarates (U.S. Pat. No. 3,304,261 and 3,341,309); polymers of ethylene with other lower olefins; etc. Also, homopolymers of ethylene (British Patents No. 848,777 and 993,744) and chlorinated polyethylene (Belgium Pat. No. 707,371) are now known as distillate pour depressants.

Natural occurring materials which have been used as pour point depressants for lubricating oils include beeswax (U.S. Pat. No. 2,107,772) and montan wax (U.S. Patents: 2,107,722; 2,132,355, 2,150,552; 2,158,370; 2,260,994).

Ozokerite is a hydrocarbon wax which has been reported to destroy the macrocrystalline structure of petroleum paraffins upon addition thereto (Kirk-Othmer Encyclopedia of Chemical Technology 2nd Ed. Vol. 22, page 169, Interscience Publishers, New York, N.Y.).

U.S. Pat. No. 3,762,888 teaches improving the cold flow properties of middle distillate fuels with a combination of oil-soluble pour point depressant polymers together with oil-soluble auxilliary, flow improving compounds.

SUMMARY OF THE INVENTION

The present invention is based upon finding that the combinations of (A) ethylene-containing polymeric pour point depressants with: (B) beeswax, (C) ozokerite wax and/or (D) long chained α-olefins are particularly effective as flow improvers in distillate fuel oils having a cloud point higher than about −15° C.

Many of the aforedescribed prior art materials, while very effective in lowering the pour point of distillate fuel oil, sometimes do not sufficiently reduce large wax particles that tend to be filtered out by the screens and other filter equipment normally used on trucks and in fuel oil storage systems, etc., with a resulting plugging even though the temperature of the oil is substantially above its pour point.

Because of this increased effectiveness in regulating wax crystal size, the additive combination of the invention is particularly useful in diesel fuels in view of the current tendency and desire to increase the cloud point by raising the distillation temperature. One advantage of increasing the cloud point is that the resulting fuel will then contain a larger proportion of higher molecular weight hydrocarbons which in turn, increases the BTU value of the fuel. The greater BTU value gives economies during the operation of diesel engines, for example, diesel trucks.

The wax crystal size of these fuels will frequently need to be controlled. For example, in the normal operation of diesel trucks, the diesel engine is usually provided with a fine mesh filter of about 50 microns, e.g. about equivalent to a 270 mesh screen, ahead of the engine. In cold weather when the ambient temperature is below the cloud point, it becomes especially essential that the wax crystals that form are sufficiently fine so that they will pass through any filters. As previously indicated, the present invention provides an additive combination which can be used to reduce or regulate the wax crystal size to thereby obtain improved cold flow properties.

In general, the compositions of the invention will comprise a major amount of a distillate fuel oil having a cloud point higher than about −15° C. and a minor, flow improving amount of: (A) an ethylene polymer pour point depressant with a co-additive of either (B) beeswax, (C) ozokerite wax and/or (D) α-olefins of at least about 24 carbon atoms, preferably greater than about 30 carbons, usually in relative ratios of 0.3 to 10, preferably 0.5 to 5, parts by weight of (A) per part by weight of (B), (C) and/or (D).

The co-additives have very long hydrocarbon chains i.e. at least about 24 carbon atoms and contain a structurally heterogeneous group such as an ester, an unsaturation and/or a cyclic structure.

THE DISTILLATE FUELS

In general, the distillate fuel oils of the invention will boil in the range of 120° C. to 400° C., and will have cloud points usually from about 5° C. to about −15° C. The fuel oil can comprise straight run, or cracked gas oil, or a blend in any proportion of straight run and thermally and/or catalytically cracked distillates, etc. The most common petroleum middle distillate fuels are kerosene, diesel fuels, jet fuels and heating oils. The low temperature flow problem is most usually encountered with diesel fuels and with heating oils. As earlier pointed out, the screens and similar structures in the fuel supply lines tend to rapidly plug up at the low temperatures.

As noted, the middle distillate fuel oils for which this invention has utility are those of a boiling range of from about 120° C. to about 400° C. and cloud points of at least about −15° C. e.g. ranging from about +5° C. to about −15° C. and are further characterized by wax contents at −29° C. of from about 2 to 15 wt. %. These middle distillate fuels are similar to the non-responsive fuels referenced in U.S. Pat. No. 3,762,888 which were cold flow improved by the teachings of said patent. It has now been found that these middle distillate fuels having a cloud point of above about −15° C. can be further improved in cold flow properties by utilizing the co-additives of this invention.

Generally there will be added to a waxy middle distillate petroleum fuel from about 0.01 to about 3 weight percent, or more preferably from about 0.05 to about 0.75 weight percent of the additive of the invention. Concentrates of the additive can also be prepared containing from 3 to 75 weight percent of the additive in a hydrocarbon oil, as for example, a distillate fuel.

A. - The Ethylene Containing Pour Depressant

In general, these polymeric pour depressants have a polymethylene backbone which is divided into segments by hydrocarbon or oxy-hydrocarbon side chains. These oil-soluble polymers will generally have a number average molecular weight in the range of about 500 to 50,000, preferably about 1,000 to about 5,000, as measured for example, by Vapor Pressure Osmometer, such as using a Mechrolab Vapor Pressure Osmometer Model 310A. Generally, they will comprise about 3 to 40, preferably 4 to 20, molar proportions of ethylene per molar proportion of a second ethylenically unsaturated monomer, which latter monomer can be single monomer or a mixture of such monomers in any proportion.

The unsaturated monomers, copolymerizable with ethylene, include unsaturated mono and diesters of the general formula:

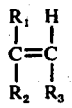

wherein $R_1$ is hydrogen or methyl; $R_2$ is a $-OOCR_4$ or $-COOR_4$ group wherein $R_4$ is hydrogen or a $C_1$ to $C_{16}$, preferably a $C_1$ to $C_4$, straight or branched chain alkyl group; and $R_3$ is hydrogen or $-COOR_4$. The monomer, when $R_1$ and $R_3$ are hydrogen and $R_2$ is $-OOCR_4$ includes vinyl alcohol esters of $C_2$ to $C_{17}$ monocarboxylic acids, preferably $C_2$ to $C_5$ monocarboxylic acid. Examples of such esters include vinyl acetate, vinyl isobutyrate, vinyl laurate, vinyl myristate, vinyl palmitate, etc. When $R_2$ is $-COOR_4$, such esters include methyl acrylate, isobutyl acrylate, methyl methacrylate, 2-ethylhexyl acrylate, $C_{13}$ oxo alcohol esters of methacrylic acid, etc. Examples of monomers where $R_1$ is hydrogen and $R_2$ and $R_3$ are $-COOR_4$ groups, include mono and diesters of unsaturated dicarboxylic acids such as: mono $C_{13}$ oxo fumarate, di-$C_{13}$ oxo fumarate, di-isopropyl maleate, di-lauryl fumarate; ethylmethyl fumarate; etc.

Another class of monomers that can be copolymerized with ethylene include $C_3$ to $C_{16}$ alpha monoolefins, which can be either branched or unbranched, such as propylene, isobutene, n-octene-1, isooctene-1, n-decene-1, dodecene-1, etc.

Still other monomers include vinyl chloride, although essentially the same result can be obtained by polyethylene chlorinated to contain about 5 to 35 wt. % chlorine. Even branched polyethylene can be used per se as the pour depressant.

These polyethylene and ethylene copolymer pour depressants are generally formed using a free radical promoter, or in some cases they can be formed by thermal polymerization, or they can be formed by Ziegler-type polymerization in the case of ethylene with other olefins. The polymers produced by free radical polymerization appear to be the more important and can be formed as follows: Solvent, and 0–50 wt. %, of the total amount of monomer other than ethylene, e.g. an ester monomer, used in the batch, are charged to a stainless steel pressure vessel which is equipped with a stirrer and cooling coil. The temperature of the pressure vessel is then brought to the desired reaction temperature, e.g. 70° to 250° C., and pressured to the desired pressure with ethylene, e.g. 800 to 10,000 psig., usually 900 to 6000 psig. Then promoter, usually diluted with the reaction solvent, and additional amounts of the second monomer, e.g. unsaturated ester, are added to the vessel continuously, or at least intermittently, during the reaction time, which continuous addition gives a more homogenous copolymer product as compared to adding all the unsaturated ester at the beginning of the reaction. Also during the reaction time, as ethylene is consumed in the polymerization reaction, additional ethylene is supplied through a pressure controlling regulator so as to maintain the desired reaction pressure fairly constant at all times. Following the completion of the reaction, usually a total reaction time of ¼ to 10 hours will suffice, the liquid products are withdrawn from the pressure vessel, and the solvent removed by stripping, leaving the polymer as residue.

B. - Beeswax

For purposes of this disclosure, either natural or a comparable synthetic beeswax can be used. The naturally occurring beeswax is an item of commerce remarkably uniform in composition irregardless of the different strains, races and varieties of bees. Typically, it has a melting point of 16°–22° C., a KOH/g. acid number of 17 to 21, an iodine number of 8–12, a specific gravity at 25° C. of 0.955–0.975 and a hardness (ASTM D-5) of 15. Although as much as 13% of the beeswax is hydrocarbon, the principal constituents are the esters. The predominant hydrocarbon is hentriacontane as in candelilla. It is estimated that as much as 23% of the total wax is myricyl palmitate, $C_{15}H_{31}COOC_{30}H_{61}$. Among the other esters present are myricyl alcohol compounds with acids, such as cerotic acid, $C_{27}H_{55}COOH$, estimated at 12% of the total, and other palmitates, such as that of lacceryl alcohol, $C_{32}H_{65}OH$, estimated at 2% of the total.

C. - Ozokerite Wax

Ozokerite is a hydrocarbon wax mixture containing hydrocarbon with ring structures embedded in a long polymethylene chain. The ozokerite hydrocarbons are higher molecular weight than the usual waxes which fall within the n-paraffin series of $C_{17}$-$C_{35}$, ie., they have from 37 to 50 carbons in the hydrocarbon chains.

D. - Long Chain α-Olefins

This coadditive includes α-olefins of chain length having at least about 24 carbons, preferably at least about 30 carbons. The preferred coadditive is exemplified by a commercially available mixture which had a carbon number distribution of about 9 wt. % of $C_{26}$ and lower, 6 wt. % of $C_{28}$, 14 wt. % of $C_{30}$, 13 wt. % of $C_{32}$, 11 wt. % of $C_{34}$ and 15 wt. % of $C_{36}$ and higher (up to about $C_{50}$). It is preferred that the long chained α-olefins have at least 30 carbons and optimally from about 30 carbons to about 50 carbons. The coadditives of the invention i.e., the beeswax, ozokerite wax and long chained α-olefins are characterized by very long hydrocarbon chains of at least about 24 carbons; preferably of at least about 28; and optimally at least about 30 and up to about 50 carbons. These coadditives can be further characterized by containing groups such as esters, unsaturation and/or cyclic ring structures which groups help impart oil solubility.

The fuel compositions of the invention will comprise a major amount of the petroleum distillate fuel, and about 0.005 to 3 wt. %, preferably 0.01 to 1.0 wt. % of the additive combination of the invention, i.e., the ethylene containing polymer with Component (B) the beeswax; and/or Component C ozokerite wax; and/or Component (D) the long chained α-olefin. Concentrates of the aforesaid additive combination can also be prepared containing 3 to 60 wt. % of the combination in a solvent, e.g., a distillate fuel, mineral oil, an aromatic hydrocarbon, etc.

The additive combinations of the invention may be used alone as the sole oil additive, or in combination with other oil additives such as corrosion inhibitors; antioxidants; sludge inhibitors; pour depressants; etc.

The invention will be further understood by reference to the following examples which include preferred embodiments of the invention.

In carrying out the Examples, the following materials were used:

Additive A - This consisted of about 55 wt. % light mineral oil and about 45 wt. % of an ethylene-vinyl acetate random copolymer having a number average molecular weight of about 1900 as determined by Vapor Pressure Osmometry, having about 1.5 methyl terminated branches (exclusive of the methyl groups in the vinyl acetate) per 1,000 molecular weight of polymer and about 38 wt. % vinyl acetate. The copolymer was prepared by copolymerizing ethylene and vinyl acetate wth dilauroyl peroxide at a temperature of about 105° C., under about 1050 psig ethylene pressure in cyclohexane solvent. A typical laboratory preparation of this polymer is as follows:

A three liter stirred autoclave is charged with about 1000 ml. of cyclohexane as solvent and about 100 ml. of vinyl acetate. The autoclave is then purged with nitrogen and then with ethylene. The autoclave is then heated to 105° C. while ethylene is pressured into the autoclave until the pressure is raised to about 1050 psig. Then, while maintaining a temperature of 105° C. and said 1050 psig. pressure, about 160 ml/hour of vinyl acetate and about 80 ml/hour of solution consisting of 9 wt. % di-lauroyl peroxide dissolved in 91 wt. % cyclohexane are continuously pumped into the autoclave at an even rate. A total of 320 ml. of vinyl acetate and 11 gm. of peroxide are injected into the reactor over a period of about 2 hours. After the last of said peroxide is injected, the batch is maintained at 105° C. for an additional 10 minutes. Then, the temperature of the reactor contents is lowered to about 60° C., the reactor is depressurized, and the contents are discharged from the autoclave. The emptied reactor is rinsed with 1 liter of warm benzene (about 50° C.) which is added to the product. The product is then stripped of the solvent and unreacted monomers on a steam bath overnight by blowing nitrogen through the product.

Further examples of this class of polymers are described in Canadian Patent 882,194. Details of measuring the branching on this type of polymer are given in Journal of Applied Polymer Science, Vol. 15, pp. 1737-1742 (1971)

Additive (B) — The beeswax, purchased from International Wax Refining, Inc., Valley Stream, New York had the following specifications:

| | |
|---|---|
| Melting point | 66° C. |
| KOH/g. acid number | 20 |
| Sap. value | 93 |
| Specific Gravity | 0.950 at 20° C. |

Additive (C) — The ozokerite wax, purchased from International Wax Refining, Inc., Valley Stream, New York had the following specifications:

| | |
|---|---|
| Melting point | 91° C. |
| KOH/g. acid number | 0.0 |
| Sap. Value | 0.0 |
| Specific Gravity | 0.915 at 20° C. |
| Paraffin content | nil |

Additive (D) — A commercially available mixture which had a carbon number distribution of about 9 wt. % of $C_{26}$ and lower, 6 wt. % of $C_{28}$, 14 wt. % of $C_{30}$, 13 wt. % of $C_{32}$, 11 wt. % of $C_{34}$ and 15 wt. % of $C_{36}$ and higher (up to about $C_{50}$).

Additive (D′) — A commercially available mixture of long chain α-olefins which had a carbon number distribution of about 26 wt. % of $C_{24}$, 43 wt. % of $C_{26}$, 21 wt. % of $C_{28}$ and 9 wt. % of $C_{30}$ and higher.

Fuel - This was a diesel fuel oil having a cloud point of −6° C., a pour point of −6° C., a specific gravity at 16° C. of 0.8403, and ASTM distillation (D-1160) of 10% at 203° C., of 50% at 284° C., and of 90% at 329° C., an aniline point of 70° C. and a wax content at −29° C. of 6.9 wt. %.

This fuel was subjected to a test for predicting the low-temperature operability of certain fuels, particularly diesel fuels. The test is conveniently referred to herein as the "Cold Filter Plug Point" (CFPP) test. The test procedure is discussed and described in detail in Journal Inst. Pet. Vol. 52, No. 510 pps. 173 to 185; in particular on pps. 184 and 185.

In brief, the CFPPT is carried out with a 45 ml. sample of the oil to be tested which is cooled in a bath maintained at about −30° F. Every 2° drop in temperature, starting from 4° F. above the cloud point, the oil is tested with a test device consisting of pipette to whose lower end is attached an inverted funnel. Stretched across the mouth of the funnel is a 350 mesh screen having an area of about 0.45 square inch. A vacuum of about 7″ of water is applied to the upper end of the pipette by means of a vacuum line while the screen is immersed in the oil sample. Due to the vacuum, oil is drawn across the screen up into the pipette to a mark indicating 20 ml. of oil. The test is repeated with each 2° drop in temperature until the oil fails to fill the pipette to the aforesaid mark due to clogging of the screen with wax crystals. The results of the test are reported as the "operability limit" or cold filter plugging point, which is the temperature in ° F. at which the oil fails to fill the pipette in prescribed time.

The results of the CFPPT comparing the additive combinations of the invention with either no additive and each additive separately are shown in the following Table:

| Test | Wt.% A.I. Added | Additive | Cold Filter Plugging Point ° F. of Fuel |
|---|---|---|---|
| 1 | — | — | +20 |
| 3 | 0.07 | A | +16 |

-continued

| Test | Wt.% A.I. Added | Additive | Cold Filter Plugging Point ° F. of Fuel |
|---|---|---|---|
| 6 | 0.07 | A | +12 |
| | 0.07 | B | |
| 5 | 0.14 | B | +26 |
| 7 | 0.14 | C | +24 |
| 8 | 0.07 | A | +10 |
| | 0.07 | C | |
| 2 | 0.06 | A | +18 |
| 4 | 0.13 | A | +10 |
| 11 | 0.14 | D | +22 |
| 9 | 0.06 | A | + 6 |
| | 0.07 | D | |
| 10 | 0.06 | A | +10 |
| | 0.07 | D' | |

The results demonstrate the utility of the inventive combinations. In this fuel the ethylene-vinyl acetate random copolymers (A) shows marginal but increasing cold flow improvement directly related to its concentration (see Tests 1–4) however, upon adding a co-additive the cold filter plugging point is reduced (for beeswax compare results of Tests 3 and 6; for ozokerite wax compare results of Tests 3 and 8) sometimes markedly reduced (for long chained $\alpha$-olefins compare results of Tests 2 and 9) even though the co-additives by themselves exhibited no cold flow improvement activity.

This invention has taught that improvements in cold flow properties of middle distillate fuels can be obtained for those fuels having a cloud point in excess of about −15° C., e.g., ranging from about +5° C. to about −15° C. Although not know for certain, it appears that the co-additives of the invention enhance the cold flow properties of these fuels which have a temperature difference in cloud point and pour point of no more than about 3° C. with marked improvement where the difference is no more than about 2° C. Surprisingly, these fuels, which decrease in responsiveness to the co-additives of U.S. Pat. No. 3,762,888 in a direct relationship to the difference between cloud point and pour point, became more responsive to the co-additives of the invention as this difference decreases. For reasons not understood, though it would appear related to the wax deposition rate of the fuel, these rather non-responsive fuels which have the difference of less than about 3° C. become improved in cold flow performance by using the co-additives of the invention which improvement appears to be inversely relates to the magnitude of the difference between cloud point and pour point.

It is to be understood that the examples present in the foregoing specification are merely illutrative of this invention and are not intended to limit it in any manner; nor is the invention to be limited by any theory regarding its operability. The scope of the invention is to be determined by the appended claims.

What is claimed is:

1. A distillate fuel oil improved in its cold flow characteristics comprising a major proportion of an atmospheric distillate petroleum oil having a cloud point of at least about −15° C., and a synergistic flow improving combination in the range of about 0.005 to 3 wt.% of:

A 0.3 to 10 parts by weight of an oil soluble ethylene-containing polymeric pour point depressant having a number average molecular weight in the range of about 500 to 50,000, and selected from the group consisting of:

1. branched polyethylene;
2. ethylene polymer chlorinated to contain about 5 to 35 wt.% chlorine;
3. copolymers of 3 to 40 molar proportions of ethylene with a $C_3$ to $C_{16}$ alpha monoolefin, or a monoethylenically unsaturated mono- or diester of the general formula:

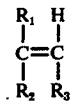

wherein $R_1$ is hydrogen or methyl; $R_2$ is a —$OOCR_4$ or -$COOR_4$ group wherein $R_4$ is hydrogen or a $C_1$ to $C_{16}$ alkyl group; and $R_3$ is hydrogen or —$COOR_4$;

per part by weight of coadditive selected from the group consisting of (B) beeswax, (C) ozokerite wax and (D) a mixture of alpha-monoolefins having at least 24 carbon atoms up to about 50 carbon atoms, wherein a major proportion by weight of said olefin mixture is $C_{30}$ and higher olefins.

2. A fuel oil according to claim 1, wherein said coadditive is said beeswax.

3. A fuel oil according to claim 1, wherein said coadditive is said ozokerite wax.

4. A fuel oil according to claim 1, wherein said coadditive is said mixture of alpha-monoolefins.

5. A fuel oil according to claim 1, wherein said ethylene-containing polymeric pour point depressant has a molecular weight in the range of about 1,000 to 5,000 and is a copolymer consisting essentially of ethylene with vinyl acetate, and wherein about 0.5 to 5 parts by weight of said copolymer is used per part by weight of said coadditive.

6. A fuel oil according to claim 5, wherein said coadditive is said mixture of alpha-monoolefins.

7. A fuel oil according to claim 5, wherein said coadditive is said beeswax.

8. A fuel oil according to claim 5, wherein said coadditive is said ozokerite wax.

9. A fuel oil according to claim 6, wherein said oil consists essentially of fuel oil boiling in the range of 120° C. to 400° C., having a cloud point of from about 5° C. to about −15° C., and a pour point within 3° C. of the cloud point.

10. An additive concentrate blend useful for improving the cold flow characteristics of petroleum fuel oil having a cloud point of at least about −15° C. comprising oil containing 3 to 75 wt.% of a mixture of:

A. 0.3 to 10 parts by weight of an oil soluble ethylene-containing polymeric pour point depressant having a number average molecular weight in the range of about 500 to 50,000, and selected from the group consisting of:

1. branched polyethylene;
2. ethylene polymer chlorinated to contain about 5 to 35 wt.% chlorine;
3. copolymers of 3 to 40 molar proportions of ethylene with a $C_3$ to $C_{16}$ alpha monoolefin, or a monoethylenically unsaturted mono- or diester of the general formula:

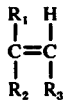

wherein $R_1$ is hydrogen or methyl; $R_2$ is a $—OOCR_4$ or $—COOR_4$ group wherein $R_4$ is hydrogen or a $C_1$ to $C_{16}$ alkyl group; and $R_3$ is hydrogen or $—COOR_4$;

per part by weight of a coadditive selected from the group consisting of (B) beeswax, (C) ozokerite wax and (D) a mixture of alpha-monoolefins having at least 24 carbon atoms up to about 50 carbon atoms, wherein a major proportion by weight of said olefin mixture is $C_{30}$ and higher olefins.

11. An additive concentrate according to claim 10, wherein said ethylene-containing pour point depressant is a copolymer of ethylene and vinyl acetate and said coadditive is said mixture of alpha-monoolefins.

* * * * *